US010342728B2

(12) United States Patent
Nelson et al.

(10) Patent No.: US 10,342,728 B2
(45) **Date of Patent: *Jul. 9, 2019**

(54) LIP ENHANCEMENT DEVICE AND METHOD

(71) Applicant: Juvalips, LLC, Circle Pines, MN (US)

(72) Inventors: Brett Nelson, Shoreview, MN (US); Gina M Fredrickson, Mountain House, CA (US); Logan Ernster, Minneapolis, MN (US); Tim Bachman, St. Paul, MN (US)

(73) Assignee: Juvalips, LLC, Circle Pines, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/138,267

(22) Filed: Sep. 21, 2018

(65) Prior Publication Data

US 2019/0021940 A1 Jan. 24, 2019

Related U.S. Application Data

(63) Continuation of application No. 15/524,039, filed as application No. PCT/US2017/026380 on Apr. 6, 2017.

(Continued)

(51) Int. Cl.
*A61H 7/00* (2006.01)

(52) U.S. Cl.
CPC ..... *A61H 7/008* (2013.01); *A61H 2201/0153* (2013.01); *A61H 2201/1207* (2013.01);
(Continued)

(58) Field of Classification Search
CPC ..... A61H 7/008; A61H 2201/0153; A61H 2201/501; A61H 2201/1207; A61H 2205/022
See application file for complete search history.

(56) References Cited

U.S. PATENT DOCUMENTS 2,063,084 A 12/1936 Farnon
3,118,667 A 1/1964 Barons
(Continued)

FOREIGN PATENT DOCUMENTS

EP 2783673 A1 10/2014
WO 2014060977 A1 4/2014

OTHER PUBLICATIONS

"Encore Deluxe Battery Powered/Manual Combo Vacuum Erection Device," Encore Vacuum Therapy, product listing; Apr. 16, 2010; https://www.healthykin.com/p-2214-encore-deluxe-battery-poweredmanual-combo-vacuum-erection-device.aspx, 2 pp.
(Continued)

*Primary Examiner* — Timothy A Stanis
(74) *Attorney, Agent, or Firm* — Grumbles Law, LLC; Brittany R. Nanzig; Stephen F. Wolf

(57) ABSTRACT

A lip-enhancement device can include a vacuum pump, a controller configured to control the vacuum pump, a pump housing structured to enclose the vacuum pump and the controller, and a mouthpiece reversibly and rigidly mountable to the pump housing. The mouthpiece can include a pump-housing-engaging side structured to reversibly mount to the pump housing on a mouthpiece-receiving side of the pump housing, and a lips-engaging side having a generally oval rim with a thermoplastic elastomer outer layer. The generally oval rim can bound a bowl, and the bowl can include a suction port providing fluidic communication between an interior of the bowl and an exterior of the bowl on the pump-housing-engaging side. The mouthpiece-receiving side of pump housing can include a suction connector structured to fluidically couple the suction port of the mouthpiece with the vacuum pump when the mouthpiece is mounted to the pump housing.

22 Claims, 6 Drawing Sheets

Related U.S. Application Data

(60) Provisional application No. 62/319,040, filed on Apr. 6, 2016.

(52) U.S. Cl.
CPC ..... *A61H 2201/501* (2013.01); *A61H 2201/5071* (2013.01); *A61H 2205/022* (2013.01)

(56) References Cited

U.S. PATENT DOCUMENTS

| | | | | |
|---|---|---|---|---|
| 3,742,607 | A | 7/1973 | Johnson | |
| D237,313 | S | 10/1975 | Harris | |
| 4,455,472 | A | 6/1984 | Moss | |
| 4,467,375 | A | 8/1984 | Sato | |
| 5,377,701 | A | 1/1995 | Fang | |
| 6,030,318 | A | 2/2000 | Howard | |
| 6,042,537 | A | 3/2000 | Kaiser | |
| 6,196,982 | B1 | 3/2001 | Ball | |
| 6,309,364 | B1 * | 10/2001 | Cathaud | A61H 7/008 601/7 |
| 6,830,590 | B1 | 12/2004 | Palahnuk et al. | |
| D515,219 | S | 2/2006 | Nan | |
| 7,083,548 | B1 | 8/2006 | Moore et al. | |
| 7,153,237 | B2 | 12/2006 | Norton | |
| D596,307 | S | 7/2009 | Stewart | |
| D599,486 | S | 9/2009 | Stewart | |
| D669,996 | S | 10/2012 | Chen | |
| 8,858,472 | B2 | 10/2014 | Gomez | |
| 8,945,104 | B2 | 2/2015 | Boone, III et al. | |
| D729,397 | S | 5/2015 | Reque | |
| D739,083 | S | 9/2015 | Ho | |
| 9,119,758 | B2 | 9/2015 | Ho | |
| D741,502 | S | 10/2015 | Gomez | |
| D762,871 | S | 8/2016 | Gomez | |
| D766,452 | S | 9/2016 | Ho | |
| D768,305 | S | 10/2016 | Ho | |
| D774,655 | S | 12/2016 | Ho | |
| D775,362 | S | 12/2016 | Ho | |
| D791,958 | S | 7/2017 | Ho | |
| D792,979 | S | 7/2017 | Ma | |
| D795,443 | S | 8/2017 | Ho | |
| D819,222 | S | 5/2018 | Nelson et al. | |
| 2003/0153869 | A1 | 8/2003 | Ytteborg | |
| 2003/0176817 | A1 | 9/2003 | Chang | |
| 2004/0073144 | A1 | 4/2004 | Carava | |
| 2006/0008778 | A1 | 1/2006 | Rosenberg | |
| 2006/0009719 | A1 * | 1/2006 | LaJoie | A45D 33/005 601/70 |
| 2007/0016277 | A1 | 1/2007 | Karat et al. | |
| 2010/0137256 | A1 | 6/2010 | Haddad | |
| 2010/0198119 | A1 * | 8/2010 | Gubernick | A45D 34/04 601/69 |
| 2011/0112445 | A1 | 5/2011 | Naldoni | |
| 2012/0208677 | A1 | 8/2012 | Lally | |
| 2012/0238913 | A1 | 9/2012 | Lin et al. | |
| 2013/0046211 | A1 | 2/2013 | Ho | |
| 2013/0110014 | A1 | 5/2013 | Luzon et al. | |
| 2013/0158447 | A1 | 6/2013 | Shabazian | |
| 2013/0274787 | A1 | 10/2013 | Bruce | |
| 2013/0303480 | A1 | 11/2013 | Horne et al. | |
| 2014/0135175 | A1 | 5/2014 | Shepherd et al. | |
| 2015/0342825 | A1 | 12/2015 | Shabazian et al. | |
| 2017/0095056 | A1 * | 4/2017 | Dudek | A45D 40/18 |

OTHER PUBLICATIONS

"Kiss Lip Plumper," PMD Beauty, www.pmdbeauty.com, retrieved from internet https://pmdbeauty.com/kiss/, Aug. 1, 2017, 5 pp.

dhgate.com; 2015 New Arrival Kemei Mens Electric Shaver Rotary 3 in 1 Mustache Ear Nose Trimmer Home protable Travel shaver men face care; product listing; 2015; https://www.dhgate.com/product/2015-new-arrival-kemei-mens-electric-shaver/257495620.html; 6 pp.

Banggood; FLYCO FS330 Triple Blade Electric Shaver Rechargeable Rotary Razor; product listing; 2014; https://www.banggood.com/FLYCO-FS330-Triple-Blade-Electric-Shaver-Rechargeable-Rotary-Razor-p-925869.html; 10 pp.

* cited by examiner

LIP ENHANCEMENT DEVICE AND METHOD

CROSS-REFERENCE TO RELATED APPLICATIONS

This application is a continuation of U.S. patent application Ser. No. 15/524,039, titled LIP ENHANCEMENT DEVICE AND METHOD, which was the National Stage of International Application No. PCT/US17/26380, filed Apr. 6, 2017, titled LIP ENHANCEMENT DEVICE AND METHOD, which claims the benefit of U.S. Provisional Application No. 62/319,040 filed Apr. 6, 2016, titled LIP SUCTION DEVICE, all of which are hereby incorporated by reference.

FIELD OF THE INVENTION

This disclosure relates to cosmetic enhancement devices, and more particularly, to devices that use negative air pressure to provide a temporary increase in lip volume.

BACKGROUND OF THE INVENTION

In today's culture, many individuals are dissatisfied with the appearance of their lips, especially as they age, and, therefore, they seek out devices and methods to increase the fullness of their lips. However, many of these devices and methods are relatively ineffective, invasive, or potentially dangerous.

For example, some cosmetics or surgeries/procedures/treatments are designed to add chemicals to the outside of an individual's lips to irritate them or to the inside of an individual's lips to directly increase their size. This irritation can cause the body to respond by increasing blood flow to the lips, thereby plumping them. However, cosmetics and some treatments can cause an uncomfortable stinging sensation in an individual's lips. Additionally, they can cause dryness and scaling of the skin on which the cosmetic or procedure is applied. Further, surgeries and/or procedures generally involve injection of a product, and are, therefore, invasive and expensive. Lastly, the use of chemicals or injected products leads to the possibility that a user can have an allergic reaction to the chemical or product.

Instead of using chemicals or products, some mechanical devices and methods exist that plump lips using suction power. Similar to cosmetics and procedures, these mechanical devices can increase blood flow to the lips. However, instead of using chemicals or injections, these devices use mechanical power to impose negative pressure on the lips. Typical mechanical devices are either ineffectual or, alternatively, injurious to an individual's mouth. Therefore, a lip-plumping device is desired that is effective and safe.

SUMMARY OF THE INVENTION

This disclosure relates to cosmetic enhancement devices, and more particularly, to devices that use negative air pressure to provide a temporary increase in lip volume. In an illustrative but non-limiting example, the disclosure provides a lip-enhancement device that can include a vacuum pump, a controller configured to control the vacuum pump, a pump housing structured to enclose the vacuum pump and the controller, and a mouthpiece reversibly and rigidly mountable to the pump housing. The mouthpiece can include a pump-housing-engaging side structured to reversibly mount to the pump housing on a mouthpiece-receiving side of the pump housing, and a lips-engaging side having a generally oval rim with a thermoplastic elastomer outer layer. The generally oval rim can bound a bowl, and the bowl can include a suction port providing fluidic communication between an interior of the bowl and an exterior of the bowl on the pump-housing-engaging side. The mouthpiece-receiving side of pump housing can include a suction connector structured to fluidically couple the suction port of the mouthpiece with the vacuum pump when the mouthpiece is mounted to the pump housing.

In some examples, the vacuum pump can be structured such that it has a mechanically-limited maximum pressure drop that it can sustain. In some such examples, the mechanically-limited maximum pressure drop is between about 27 to about 40 kPa.

In some examples, the vacuum pump can be a diaphragm pump.

In some examples, the controller can be configured to activate the vacuum pump for not longer than a predetermined time interval in a single instance.

In some examples, the controller can be configured to selectively actuate the vacuum pump to provide a free-flow pumping rate between about 0.30 to about 0.45 L/min when actuated.

In some examples, the lip-enhancement device can further include at least one structure configured to prevent substantially complete fluidic sealing of the suction port of the bowl of the mouthpiece by a lip of a user. In some instances, the structure(s) configured to prevent substantially complete fluidic sealing of the suction port can include a porous pad. In these cases, the porous pad and the bowl can be correspondingly dimensioned such that the porous pad can be releasably retained in the bowl of the mouthpiece via a friction fit. The porous pad can include a non-woven fabric. In some instances, the structure(s) configured to prevent substantially complete fluidic sealing of the suction port can include a structure integrally molded into the bowl. The structure integrally molded into the bowl can include at least one groove.

In some examples, the suction port of the bowl of the mouthpiece and the oval rim bounding the bowl can topologically define two fluidic paths connecting the interior of the bowl with the exterior of the bowl, the two fluidic paths being the only fluidic paths connecting the interior of the bowl with the exterior of the bowl.

In some examples, the device can further include a single activation button substantially flush with the pump housing.

In some examples, the device can further include a single activation button, where when the vacuum pump is deactivated, the controller can be configured to responsively activate the pump when the single activation button is released after being pressed.

In some examples, the device can further include a single activation button, where when the vacuum pump is activated, the controller can be configured to responsively de-activate the pump when the single activation button is pressed.

In some examples, the device can be constructed to be easily and ergonomically held by a single hand of a user.

In some examples, the vacuum pump can pump fluid from the exterior of the pump housing and exhaust said fluid within the pump housing. In some of these examples, the pump housing can include at least one elongate seam dimensioned to vent fluid from within the pump housing to a space exterior to the pump housing In another illustrative but non-limiting example, the disclosure provides a lip-enhancement device that can include a vacuum pump, a controller configured to control the vacuum pump, a pump housing structured to enclose the vacuum pump and the controller, a mouthpiece reversibly and rigidly mountable to the pump housing, and a porous pad that can including a non-woven fabric. The vacuum pump can be structured such that it has a mechanically-limited maximum pressure drop that it can sustain between about 27 to about 40 kPa. The controller can be configured to selectively actuate the vacuum pump to provide a free-flow pumping rate between about 0.30 to about 0.45 L/min when actuated. The mouthpiece can include a pump-housing-engaging side structured to reversibly mount to the pump housing on a mouthpiece-receiving side of the pump housing, and a lips-engaging side having a generally oval rim with a thermoplastic elastomer outer layer. The generally oval rim can bound a bowl, and the bowl can include a suction port providing fluidic communication between an interior of the bowl and an exterior of the bowl on the pump-housing-engaging side. The mouthpiece-receiving side of pump housing can include a suction connector structured to fluidically couple the suction port of the mouthpiece with the vacuum pump when the mouthpiece is mounted to the pump housing. The porous pad and the bowl can be correspondingly dimensioned such that the porous pad is releasably retained in the bowl of the mouthpiece via a friction fit. The porous pad can be configured to prevent substantially complete fluidic sealing of the suction port of the bowl of the mouthpiece by a lip of a user.

In yet another illustrative but non-limiting example, the disclosure provides a method for enhancing lips. The method can include positioning a lip-enhancement device as described herein to a user's lips and activating the vacuum pump of the lip-enhancement device, the vacuum pump drawing fluid from the bowl of the mouthpiece to produce a vacuum therein. In some cases, the vacuum produced does not exceed a pressure drop of 40 kPa. In some cases, the controller of the lip-enhancement device can deactivate the vacuum pump after a predetermined time interval. In some cases, the method can include optionally re-activating the vacuum pump of the lip-enhancement device for an additional predetermined time interval.

In some cases, the method can include applying a topical substance to the user's lips. In some cases, the topical substance can be applied prior to application of suction to the user's lips. In some cases, the topical substance can be applied after application of suction to the user's lips. In some instances, the topical substance can be a lip balm, such as a moisturizer. In some instances, the topical substance can be a serum to enhance plumping effects.

In some cases, the method specifically does not include applying a topical substance to the user's lips. In some cases, the method specifically includes not applying a topical substance to the user's lips.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
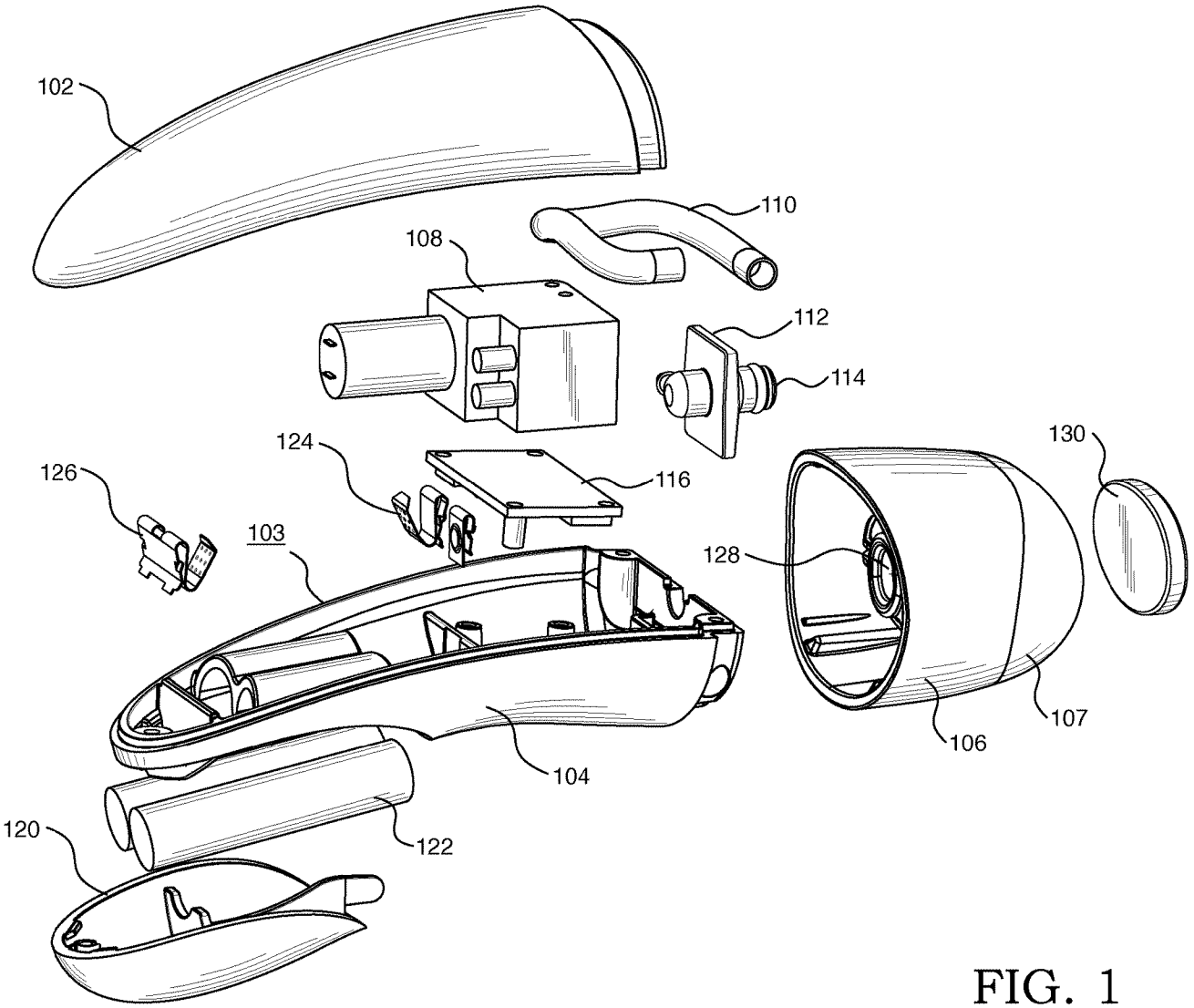
FIG. 1 is a schematic perspective exploded view of a lip suction device according to one embodiment of the present disclosure.

The present disclosure relates to a lip enhancement or suction device that can be used to increase lip volume and improve appearance. Various embodiments of the lip suction device will be described in detail with reference to the drawings, wherein like reference numerals represent like parts and assemblies throughout the several views. Reference to various embodiments does not limit the scope of the lip suction device disclosed herein. Additionally, any examples set forth in this specification are not intended to be limiting and merely set forth some of the many possible embodiments for the lip suction device. It is understood that various omissions and substitutions of equivalents are contemplated as circumstances may suggest or render expedient, but these are intended to cover applications or embodiments without departing from the spirit or scope of the disclosure. Although examples of construction, dimensions, and materials may be illustrated for the various elements, those skilled in the art will recognize that many of the examples provided have suitable alternatives that may be utilized. Also, it is to be understood that the phraseology and terminology used herein are for the purpose of description and should not be regarded as limiting.

Embodiments of the lip suction device disclosed herein include features suited for use on an individual's lips. However, some embodiments of the lip suction device may be used on other body parts or tissues. The lip suction device is designed such that it can align with a user's mouth, create a vacuum around the user's lips, and thereby stimulate an increase in lip volume using negative pressure.

Generally, the lip suction device can be an electronic, handheld device constructed to be easily and ergonomically held by a single hand of a user. As illustrated in FIG. 1, which is a schematic perspective exploded view, the device can include a pump housing, which can include an upper housing 102, a lower housing 104, and a battery tray lid 120, although this is not limiting and other pump housing configurations are possible. The device can include a mouthpiece 106 configured to be reversibly and rigidly mountable to the pump housing. By "rigidly mountable," it is meant that the when the mouthpiece is mounted to the pump housing, the pump housing and mouthpiece can substantially move together as a unified assembly, with minimal or negligible relative motion between the housing and mouthpiece. The mouthpiece 106 can include a pump-housing-engaging side structured to reversibly mount to the pump housing on a mouthpiece-receiving side of the pump housing, and a lips-engaging side having a generally oval rim with a thermoplastic elastomer outer layer 107. The generally oval rim can bound, define, or otherwise demark an outer extent of a bowl or cavity configured to receive a user's lips generally therein.

The bowl can include an aperture or suction port 128 in or near its center. The suction port 128 can provide fluidic communication between an interior of the bowl (the interior facing the user, into which the user's lips engage during use) and an exterior of the bowl on the pump-housing-engaging side of the mouthpiece. In some embodiments, and as illustrated in at least FIGS. 1, 5A, 6, and 9, the suction port 128 of the bowl of the mouthpiece 106 and the oval rim bounding the bowl can topologically define two fluidic paths connecting the interior of the bowl with the exterior of the bowl, with the two fluidic paths being the only fluidic paths connecting the interior of the bowl with the exterior of the bowl. Expressed more colloquially, in some embodiments there is only one port (port 128) through which fluid can be pumped from the bowl of the mouthpiece to provide suction.

The lip suction device can include a vacuum pump 108 in fluidic communication with the aperture or suction port 128 of the mouthpiece 106. A fluidic connection between the vacuum pump 108 and the suction port 128 of the mouthpiece 106 can be provided via a suction connector 114 on the mouthpiece-receiving side of pump housing. When the mouthpiece 106 is mounted to the pump housing, the suction connector 114 can mate into the suction port 108, with fluidic sealing therebetween being assisted by one or more o-rings. Details of this connection are illustrated in the cross-sectional view of FIG. 9. Suction connector 114 can be provided on a suction adapter plate 112 located at the mouthpiece-receiving side of pump housing. The suction adapter plate 112 can include a barbed fitting that can fluidically connect a vacuum tube 110 to the suction connector 114, with the other end of the vacuum tube being connected to the vacuum pump 108. However, this particular arrangement for connecting vacuum pump 108 to suction connector 114 (via vacuum tube 110 and suction adapter plate 112) is not limiting and other arrangements are possible. For example, in alternate embodiments, a vacuum pump could include a suction connector structured and positioned to directly connect to the suction port 128 of mouthpiece 106, without an intervening vacuum tube 110 or suction adapter plate 112.

The lip suction device can include a single activation button 118. In some embodiments, a user interface for the lip suction device can include more than one button. Activation button 118 can be functionally coupled to a controller 116 configured to control vacuum pump 108. The controller 116 can control the delivery of power to the vacuum pump 108 from a power source 122, which can be one or more conventional single-use or rechargeable batteries or any other suitable power source. The lip suction device can include battery contacts 124, 126 for batteries. In the embodiment illustrated in the Figures, power source 122 can comprise a pair of AA-type batteries. In some embodiments, the lip suction device may not include internal energy storage and can receive operational power via a power cord or another mode of power transmission.

The majority of housing and the mouthpiece 106 of the lip suction device can be made of a rigid material such as, but not limited to, plastic or metal. In some embodiments, at least an outer, forward portion 107 of the mouthpiece 106 can comprise a thermoplastic elastomer, particularly portions of the mouthpiece that contact a user's lips. For example, the outer, forward surface 107 of the mouthpiece 106 around the rim of the bowl can include a thermoplastic elastomer overmolded over a rigid, plastic ridge or lip made out of, for example, polycarbonate acrylonitrile-butadiene styrene ("PC/ABS"). In other embodiments, a majority of (or the entire) mouthpiece 106 can comprise a thermoplastic elastomer. As a soft, malleable feature (as provided by thermoplastic elastomer), the forward, outer portion 107 of mouthpiece 106 can more accurately seal onto a user's lips and face than a rigid mouthpiece would. It may also be more comfortable for the user. For example, if the user is using a mouthpiece 106 including a thermoplastic elastomer outer layer, when the user activates the device, the outer layer may conform to the user's face to create the vacuum seal. On the other hand, if the user uses a rigid mouthpiece 106, when the user activates the device, the user's lips and face may have to conform to the device in order to create the vacuum seal.

Figure 3:
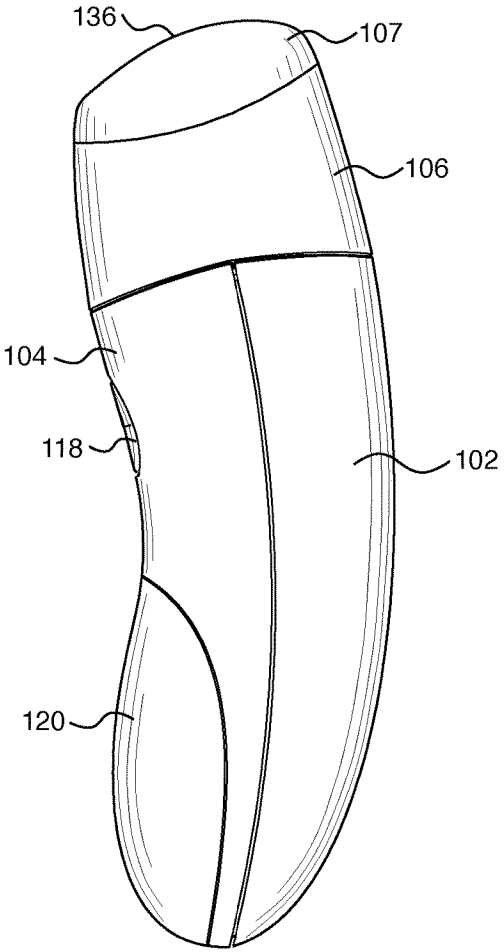
FIG. 3 is a schematic left side elevational view of the lip suction device of FIG. 1.

A general exterior shape of an embodiment of the lip suction device is illustrated in FIGS. 2-6. As illustrated in at least FIGS. 2 and 4, the front of the device may be slightly wider than the back of the device. As illustrated in FIG. 3, the height of the device from top to bottom can be relatively uniform. Additionally, in some embodiments, the lip suction device can take a curved or arced shape from the front of the device to the back as illustrated in at least FIGS. 3, 6, and 9. This curvature can enable a user to more easily and ergonomically grasp the handheld device during use. The device also can be easy to grasp because of its smooth and uniform surface.

Figure 2:
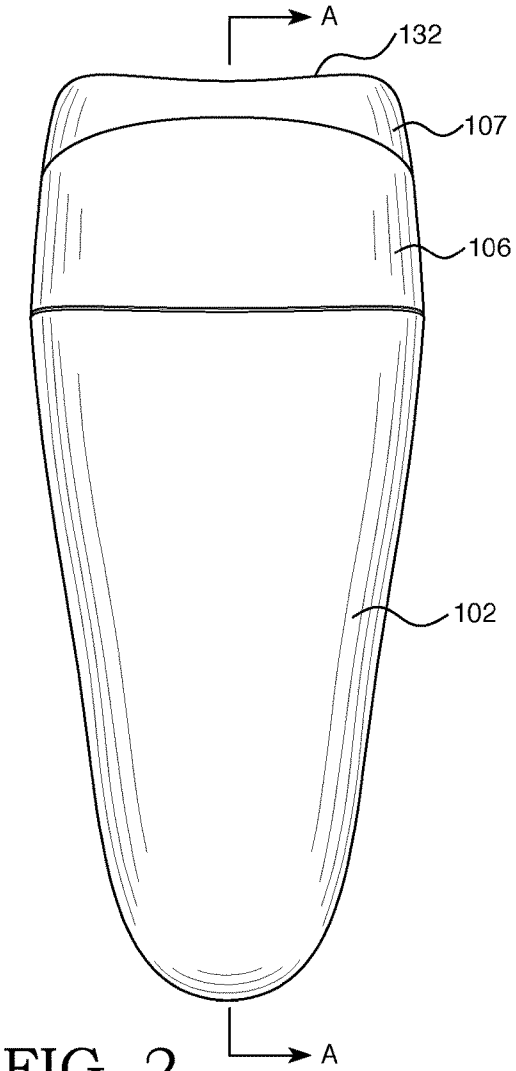
FIG. 2 is a schematic top plan view of the lip suction device of FIG. 1.
Figure 4:
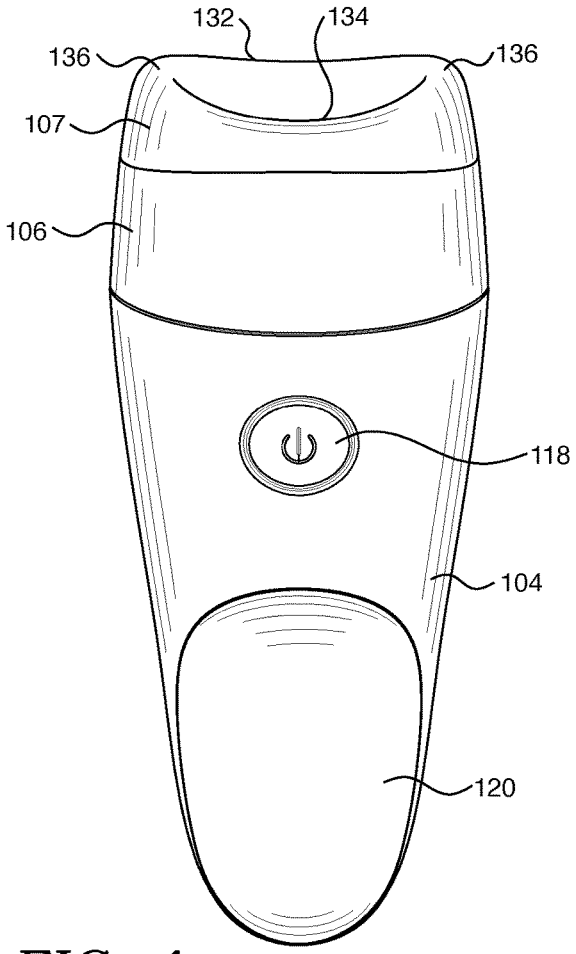
FIG. 4 is a schematic bottom plan view of the lip suction device of FIG. 1.

In general, the lip suction device can have relatively smooth and rounded outer surfaces, as illustrated in many of the Figures. As illustrated in FIG. 2, the upper housing 102 can have a relatively uniform surface, and not have any buttons, gaps, or holes. Similarly, the lower housing 104 can have a relatively uniform surface, as illustrated in FIG. 4, and not have any button, gaps, or holes aside from the activation button 118, which can be substantially flush with the surface, as illustrated in FIG. 3. The mouthpiece 106 also can have a relatively uniform surface so as not to risk a user's lips getting caught or cut on the surface.

According to an embodiment of the present disclosure, the mouthpiece 106 of the lip suction device can be placed over and/or around an individual's lips at the bowl of the mouthpiece, the activation button 118 can be pressed, and the vacuum pump 108 thereby activated such that it pulls air out of the mouthpiece 106 through the suction port 128 and discharges the air into the housing, as discussed further herein. As described above, use of the lip suction device on an individual's lips can cause additional blood to flow to the individual's lips and, therefore, result in increased lip volume. The device has been designed to yield increased lip volume in an individual for several hours.

Figure 6:
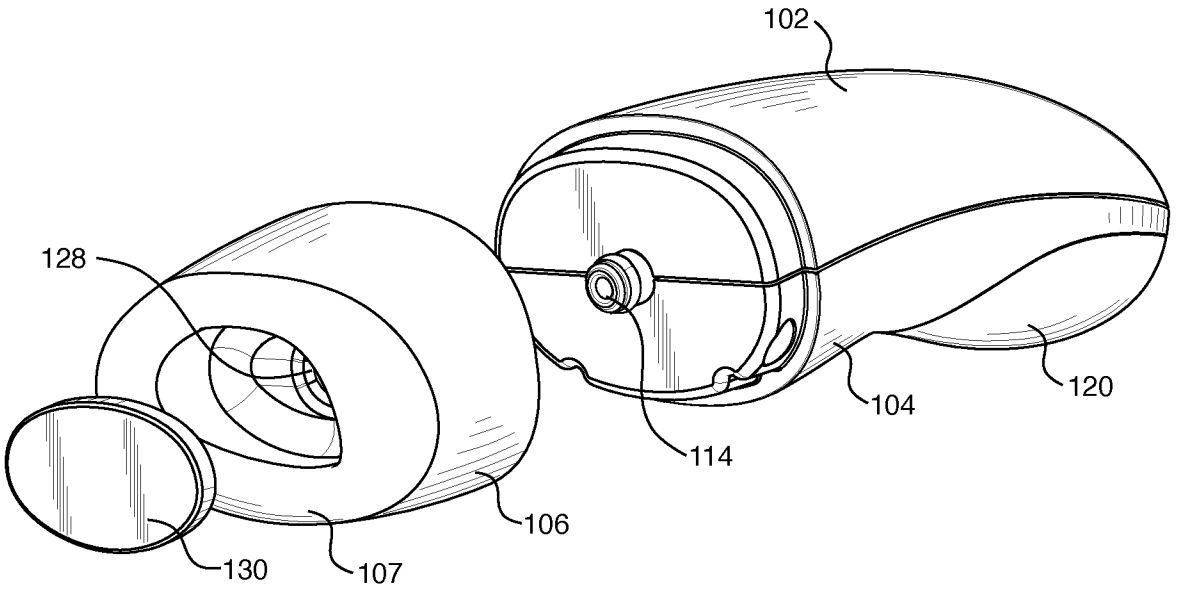
FIG. 6 is a schematic front left perspective view of the lip suction device of FIG. 1, with the mouthpiece separated from the pump housing and the porous pad separated from the bowl of the mouthpiece.
Figure 7:
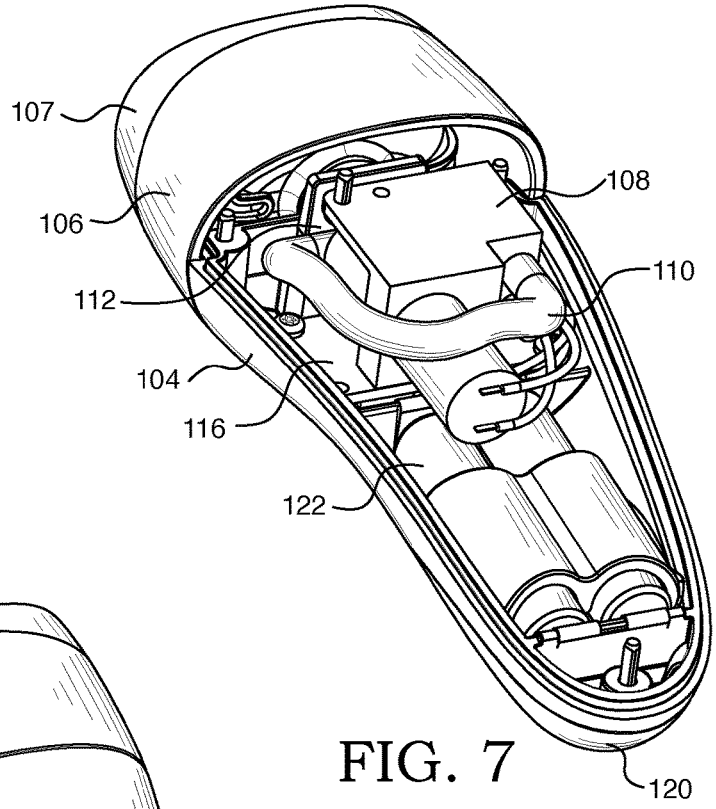
FIG. 7 is a schematic top back left perspective view of the lip suction device of FIG. 1 with a portion of housing removed to illustrate some internal components.

In some embodiments, the mouthpiece 106 is removable from the housing, as illustrated in FIG. 6. Therefore, the mouthpiece 106 can be removed from the rest of the housing and cleaned without worry of affecting the electronic components within the pump housing. Mouthpiece 106 can be reversibly attached to the housing in various ways. Some examples include, but are not limited to, a snap fit, a magnetic attachment, or a twist-on feature. In some embodiments, mating of the suction connector 114 (protruding out from the housing) to the suction port 128 of the mouthpiece can provide security of the mouthpiece 106 to the housing for example, via their mutual friction fit. Such a friction fit may be facilitated by o-rings that also can provide fluidic sealing.

Due to the removability of the mouthpiece 106, various sizes of the mouthpiece 106 can be manufactured, and users can determine what size and shape mouthpiece 106 they desire to use based on what sizes fit best over their lips and/or which lip(s) or portion(s) thereof the users wish to treat. In some embodiments, substantially the entire upper vermillion and lower vermillion of a user's lips may fit within or into the bowl of the mouthpiece 106. In some embodiments, a majority of the upper vermillion and lower vermillion of a user's lips may fit within or into the bowl of the mouthpiece 106. In some embodiments, a mouthpiece can be provided that is configured to receive a single lip. In some cases, more plumping is desired for the upper lip. In some embodiments, a mouthpiece can be configured to apply vacuum to an area substantially smaller than an entire lip or pair of lips.

The entire mouthpiece 106 may, in some embodiments, vary in size. However, in other embodiments, the outside of the mouthpiece 106 retains the same size and only the opening to the bowl changes in size. The opening of the mouthpiece 106 can be designed so as to have a curvature and ergonomic shape that fits and/or conforms to the natural shape of a user's lips and face. For example, the opening of the mouthpiece 106 may be oval. Furthermore, the shape of the rim that bounds or defines the opening of the mouthpiece can vary in curvature around its perimeter to conform to the shape of a user's mouth and face, as illustrated in the Figures. For example, as perhaps most easily seen in FIGS. 2, 3, and 4, the sides 136 of the rim can be convex and the top 132 and bottom 134 of the rim can be concave, with the upper curve 132 having a larger radius of curvature than the lower curve 134. These curvatures of the rim have been found to be generally suitable for the mouth/facial anatomy of a variety of users, but other curvature configurations are possible.

Figure 9:
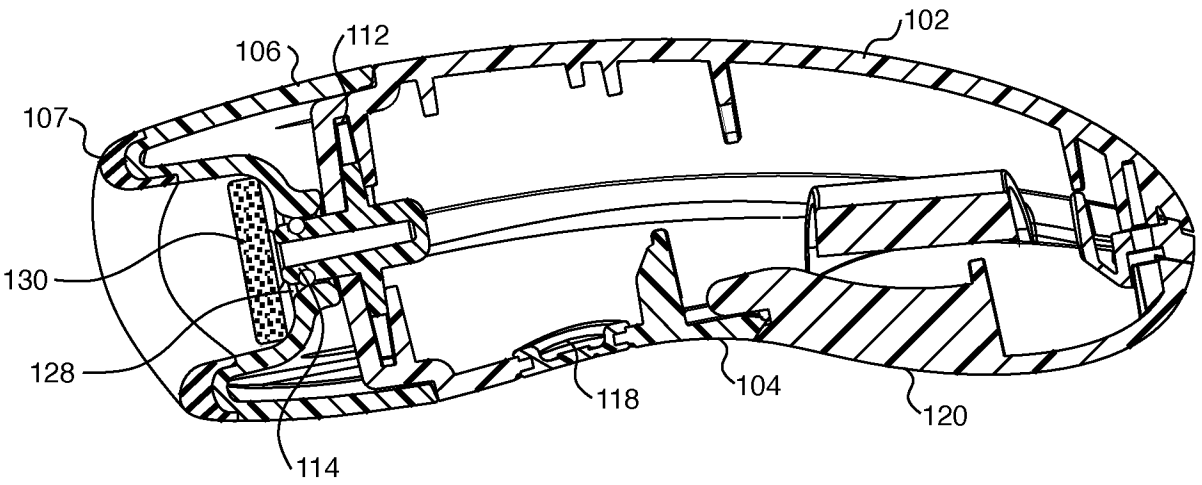
FIG. 9 is a schematic left side cross-sectional view of the lip suction device of FIG. 1 taken from the line A-A in FIG. 2.

As described above, the mouthpiece 106 can be designed and shaped with a bowl or cavity, as illustrated in at least FIGS. 5A, 5B, 6, and 9, into which a user can insert his or her lips and out of which air can be pulled when the device is activated. In some embodiments, the cavity can be deep enough that a user's lips will not touch the bottom of the cavity and will not contact the suction port 128 and/or suction connector 114 that may protrude through the suction port 128 slightly into the bowl/cavity, as illustrated in FIG. 9. If a user's lip(s) was/were to "bottom-out" and touch or otherwise contact the suction port 128 and/or suction connector 114, which is where the air is exhausted from the cavity/bowl, the lip(s) could obstruct and completely fluidically deal the suction port and/or connector, preventing vacuum pump from effectively maintaining vacuum in the bowl of the mouthpiece 106. This could prevent effective application of suction to a user's lips. In some embodiments, the controller 116 of the device can detect such an obstruction and can shut off the pump in such an eventuality.

In the present disclosure and claims, fluidic sealing or obstruction of the suction port 128 and suction connector 114 are referred-to interchangeably, to allow for variations of the exact structure of the mated port and connector. For example, in some embodiments, as noted elsewhere herein, the suction connector 114 may protrude through the suction port 128 into the bowl, whereas in other embodiments, the suction connector may seat within the suction port below the inner surface of the bowl. In the former case, a lip might encounter the suction connector first, whereas in the latter, a lip might encounter the suction port first. It will be recognized that in either configuration, a possibility of a lip sealing a suction path may exist, and recitation of one possibility should be construed as including both possibilities.

Figure 5A:
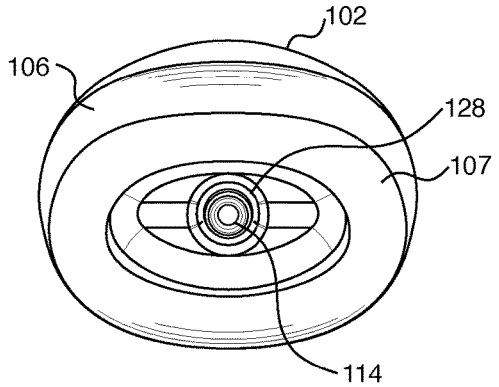
FIG. 5A is a schematic front elevational view of the lip suction device of FIG. 1 without a porous pad in the bowl of the mouthpiece.
Figure 5B:
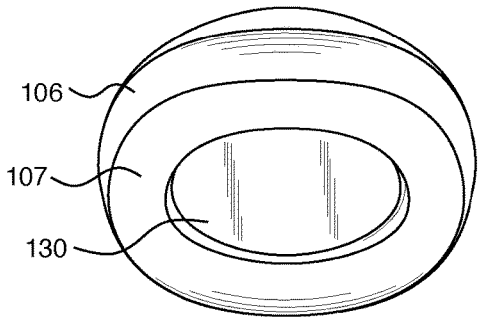
FIG. 5B is a schematic front elevational view of the lip suction device of FIG. 1 with a porous pad in the bowl of the mouthpiece.

In some cases, depth of the bowl of the mouthpiece may not prevent sealing of the suction port 128 (and/or suction connector 114). In some embodiments, the device can be provided with at least one structure configured to prevent substantially complete fluidic sealing or obstruction of the suction port 128 of the bowl of the mouthpiece 106 by a lip of a user. In some embodiments, such a structure can include a porous pad 130 or media that can prevent substantially complete fluidic sealing or obstruction of the suction port 128. The porous pad can prevent substantially complete fluidic sealing or obstruction of the suction port 128 by providing many alternative, dispersed paths for fluid flow (or "vacuum suction") from the bowl to the suction port. The porous pad can be disposed within the bowl of the mouthpiece adjacent the suction port 128. FIGS. 5A and 5B are front elevational views that schematically illustrate the lip suction device, showing the bowl of mouthpiece 106 without and with porous pad 130 disposed within, respectively. The cross-sectional view of FIG. 9 also illustrates porous pad 130 disposed within the bowl of mouthpiece 106. The porous pad and the bowl can be correspondingly dimensioned such that the porous pad can be releasably retained in the bowl of the mouthpiece via a friction fit. The porous pad can be made of any suitable porous medium, such as (but not limited to) felt, fabric, or foam. In some embodiments, the porous pad can comprise a non-woven fabric, such as a felt.

In some embodiments, the mouthpiece 106 can include at least one structure integrally molded into the bowl to prevent fluidic sealing or obstruction of the suction port 128 and/or suction connector 114. In some examples, such a structure can include at least one groove that could provide a path of fluid flow. In some embodiments, the suction connector 114 could include grooves, slots, or other structures to prevent fluidic sealing or obstruction.

Figure 8:
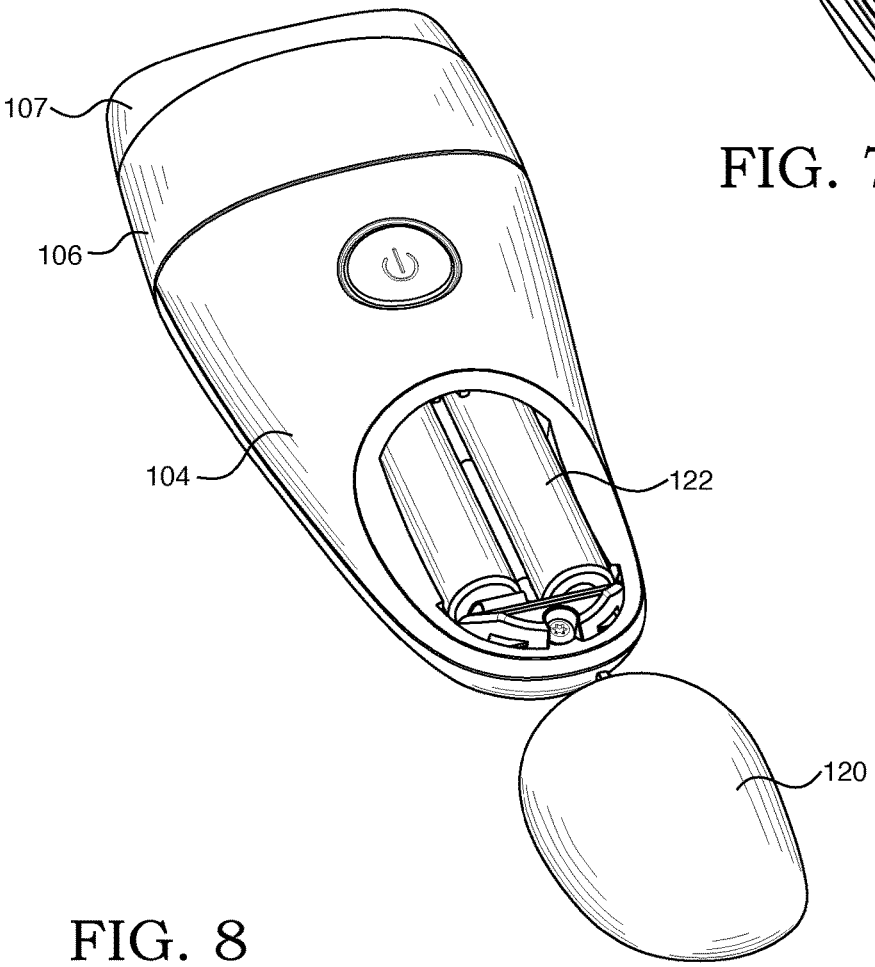
FIG. 8 is a schematic bottom right perspective view of the lip suction device of FIG. 1 that illustrates the battery tray lid separated from the housing.

As described herein, the lip suction device can be electronic and handheld and can be turned on by pressing the activation button 118. The activation button 118 can be centrally located on the lower housing 104, as illustrated in FIGS. 4 and 8, where it may be ergonomically placed under a user's thumb when the device is gripped, but in other embodiments it can be located anywhere on the external surface of the device.

When pressed, the activation button 118 can provide a signal to the controller 116, which can responsively activate or de-activate the vacuum pump 108 by supplying or not supplying, respectively, electrical power to the pump. In one example, the controller 116 can provide power to the vacuum pump 108 essentially immediately upon activation button 118 being pressed. In another example, the controller 116 can provide power to activate the vacuum pump 108 only when the activation button 118 is released after being pressed. This latter mode (activation after the button is released) can be a user-interface feature to improve responsiveness of the device, in that the controller 116 also can be programmed such that, when the vacuum pump 108 is activated, the controller can de-activate the vacuum pump immediately upon a subsequent press of the activation button 118. The responsiveness feature can include the fact that since the vacuum pump 108 is only activated when the button is released, the released button is available immediately to be pressed to de-activate the pump.

In an alternative user-interface arrangement that was tested, the pump was activated immediately upon the button being pressed, and remained activated as long as the button continued to be pressed. In some ways, this arrangement was not preferred, as it was found that many users continued holding the button indefinitely, with the pump remaining activated. When they eventually released the button, pumping action continued, which could be counter to some users' expectations.

As described herein, controller 116 of the lip suction device can control delivery of electrical power to the motor in the vacuum pump 108 and, accordingly, the duration of time for which the vacuum pump 108 runs when activated. In one embodiment, the controller 116 can be configured to provide power to (and hence activate) the vacuum pump for not longer than a predetermined time interval during a single instance of activation. This can be a safeguard feature, by automatically limiting the amount of time that vacuum is applied to a user's lips. In some examples, the predetermined time interval can be 60 seconds, but this is not limiting, and any suitable time interval can be employed. As described elsewhere herein, another safeguard feature can include the controller 116 being configured to de-activate the vacuum pump 108 when a user pushes the activation button 118 subsequent to having activated the vacuum pump.

In some embodiments, the controller 116 can be configured to annunciate an alarm or otherwise provide notice to a user if use of the lip suction device exceeds a predetermined threshold, such as the vacuum pump 108 being activated for more than a predetermined number of times, or for more than a predetermined cumulative amount of time, over a given time span. For example, an alarm or notice could be provided if the vacuum pump 108 were to be activated more than three times in a five minute time span, and/or if it were to be activated for more than three minutes in a five minute time span. Of course, these are just examples, and any suitable predetermined thresholds, limits, or conditions could be defined as triggers for alarms or notifications. Such notifications could guide a user toward the goal of safe and effective use of the lip suction device.

Vacuum pump 108 can be any suitable vacuum pump, incorporating any suitable pumping technology. Vacuum pump 108, when activated, can achieve, realize, produce, or cause a pressure drop (meaning a decrease in gauge pressure relative to ambient atmospheric pressure), for example at a suction port of the pump, and by extension in the bowl of the mouthpiece 106 to which the pump can be fluidically connected. The pressure drop realized by a vacuum pump can depend on multiple factors, including (but not limited to) the design of the pump and the supply of electrical power to the pump from a controller. In some embodiments, vacuum pump 108 of a lip suction device of the present disclosure can be structured such that it has a mechanically-limited maximum pressure drop that it can sustain. In some cases, such a mechanically-limited maximum pressure drop can be an inherent feature of the pump design. In some embodiments, vacuum pump 108 can be a diaphragm pump, which can feature a mechanically-limited maximum pressure drop that it can sustain. In some embodiments, a lip suction device of the present disclosure can include a vacuum pump whose mechanically-limited maximum pressure drop that it can sustain coincides with maximum pressure drop that is specified for therapeutic reasons. For example, it has been observed that pressure drops exceeding about 40 kPa (about 12 inches of mercury) can result in lip bruising. Accordingly, incorporation of a vacuum pump 108 whose mechanical design inherently prevents it from exceeding a given pressure drop (such as 40 kPa) can represent an inherent safety feature of the lip suction device. In some cases, effective lip plumping can be achieved at pressure drops substantially lower than 40 kPa, such as about 27 kPa (about 8 inches of mercury) or about 30 kPa. Some embodiments of the lip suction device can include a vacuum pump with a mechanically-limited maximum pressure drop between about 27 to 40 kPa (about 8 to 12 inches of mercury). In some other embodiments, maximum pressure drop can be governed by the controller via electronic control of the pump, rather than by mechanical design of the pump. In some embodiments, one or more pressure sensors can be employed in combination with feedback control of the vacuum pump by the controller.

In a non-limiting example, the lip suction device can include a vacuum pump 108, which can include a motor that the controller 116 can drive at 3 VDC and 75% duty cycle via pulse width modulation. In some embodiments, vacuum pump 108 is an Alldoo Micropump Co., Ltd. ChinaMicroPump CMP-11E that has a maximum free-flow pumping rate specification of about 0.5 L/min, and a maximum vacuum (pressure-drop) specification of about 300 millibar (about 30 kPa), or about 8.9 inches of mercury. Changing the duty cycle at which this pump is driven can affect the volume flow rate of the pump without substantially affecting the maximum pressure drop that the vacuum pump can effect. The duty cycle at which the pump is driven can affect the amount of noise produced by the pump. It was found that when the pump was driven at 100% duty cycle, the acoustic noise produced by the pump could be objectionable, and also that the vacuum flow rate achieved by the pump could result in a subjectively "too quick" onset of vacuum on users' lips. At about 50% duty cycle, noise was reduced, but the vacuum flow rate could result in a subjectively "too slow" onset of vacuum on users' lips. Driving at about 75% duty cycle, corresponding to a free-flow pumping rate of about 0.375 L/min, was found to provide an acceptable combination of noise and onset of vacuum. In some embodiments, vacuum pump 108 can be driven to provide a free-flow pumping rate between about 0.35 and 0.40 L/min. In some embodiments, vacuum pump 108 can be driven to provide a free-flow pumping rate between about 0.30 and 0.45 L/min.

In some embodiments, control parameters such as voltage and duty cycle supplied to the vacuum pump 108 and the duration of time for which the vacuum pump runs when activated can be factory set and not adjustable by an end user. In other embodiments, such parameters can be adjustable via any suitable user interface, which can include a button or buttons on the device, or via a user interface on a computing device such as a smartphone or tablet computer, which could communicate with the controller of the lip suction device via any suitable communication protocol.

As described above, when a user places his or her lips in the mouthpiece 106 and presses the activation button 118, the vacuum pump 108 can be activated and create a vacuum (pressure drop) in the cavity of the mouthpiece 106. More specifically, when the user places his or her lips 25 in the mouthpiece 106, the user can seal off the outer ring of the mouthpiece 106 and substantially prevent air from entering the cavity. Then, when the vacuum pump 108 is activated, air can be withdrawn, resulting in a pressure drop in the bowl of the mouthpiece 106. The air exhausted from the cavity can be drawn through suction port 128 and suction connector 114. From the suction port 128 and connector 114, the air can travel to the vacuum pump 108 (via 30 vacuum tube 110) and into the interior of the housing. Therefore, the vacuum pump 108 generally can draw air in from the cavity and exhaust it inside the housing. The lip suction device can be structured with one or more vents to provide a path or paths for air exhausted inside the housing to exit the housing. Such vents can be obscured from a user by incorporating them into other features of the housing, such as by dimensioning/tolerancing elongate seams 103 between upper housing 102 and lower housing 104, and/or between lower housing 104 and battery tray lid 120, to provide such vents for allowing exhausted air to be released out from the device into the atmosphere. An additional benefit to having air flow through the housing is that the air can cool the vacuum pump motor.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A lip-enhancement device, comprising:

a vacuum pump;

a controller configured to control the vacuum pump;

a pump housing structured to enclose the vacuum pump and the controller; and a mouthpiece removably and rigidly mountable to the pump housing, the mouthpiece including:

a pump-housing-engaging side structured to releasably mount to the pump housing on a mouthpiece-receiving side of the pump housing; and a lips-engaging side having a round rim with an elastomer outer surface, the round rim bounding a bowl, the bowl including a suction port providing fluidic communication between an interior of the bowl and an exterior of the bowl on the pump-housing-engaging side, wherein the mouthpiece-receiving side of the pump housing includes a suction connector structured to fluidically couple the suction port of the mouthpiece with the vacuum pump when the mouthpiece is mounted to the pump housing, wherein the suction connector comprises a releasable porous pad, configured to prevent complete fluidic sealing of the suction port of the bowl of the mouthpiece and the suction connector of the pump housing by a lip of a user.

2. The device of claim 1, wherein the vacuum pump is structured such that it has a mechanically-limited maximum pressure drop that it can sustain.

3. The device of claim 2, wherein the vacuum pump is a diaphragm pump.

4. The device of claim 2, wherein the mechanically-limited maximum pressure drop is between 27 to 40 kilopascal (kPa).

5. The device of claim 1, wherein the controller is configured to activate the vacuum pump for not longer than a predetermined time interval in a single instance.

6. The device of claim 1, wherein the controller is configured to selectively actuate the vacuum pump to provide a free-flow pumping rate between 0.30 to 0.45 liters/minute (L/min) when actuated.

7. The device of claim 1, wherein the releasable porous pad and the bowl are correspondingly dimensioned such that the releasable porous pad is configured to be releasably retained in the bowl of the mouthpiece via a friction fit.

8. The device of claim 1, wherein the releasable porous pad comprises a non-woven fabric.

9. The device of claim 1, wherein the releasable porous pad comprises a foam.

10. The device of claim 1, wherein the suction port of the bowl of the mouthpiece and the round rim bounding the bowl topologically define two fluidic paths connecting the interior of the bowl with the exterior of the bowl, the two fluidic paths being the only fluidic paths connecting the interior of the bowl with the exterior of the bowl.

11. The device of claim 1, further comprising a single activation button flush with the pump housing.

12. The device of claim 1, further comprising a single activation button, wherein when the vacuum pump is deactivated, the controller is configured to responsively activate the pump when the single activation button is released after being pressed.

13. The device of claim 1, further comprising a single activation button, wherein when the vacuum pump is activated, the controller is configured to responsively de-activate the pump when the single activation button is pressed.

14. The device of claim 1, wherein the device is constructed to be held by a single hand of a user.

15. The device of claim 1, wherein the vacuum pump is configured to pump fluid from exterior the pump housing and exhausts said fluid within the pump housing.

16. The device of claim 15, wherein the pump housing includes at least one elongate seam dimensioned to vent fluid from within the pump housing to a space exterior to the pump housing.

17. The device of claim 1, wherein the mouthpiece is structured and configured such that at least a majority of an upper vermillion and a lower vermillion of a user's lips can be positioned in the bowl of the mouthpiece.

18. The device of claim 1, further comprising a power source contained within the pump housing.

19. The device of claim 1, wherein the round rim defines an oval shape.

20. The device of claim 1, wherein the round rim, when viewed from a left or a right side of the device, is convex, and when viewed from a top or a bottom side of the device, is concave.

21. The device of claim 1, wherein the pump housing defines an arced shape from the mouthpiece-receiving side of the pump housing to an opposing end of the pump housing.

22. A method for enhancing lips, comprising:

positioning a lip-enhancement device to a user's lips, the lip-enhancement device including:

a vacuum pump;

a controller configured to control the vacuum pump;

a pump housing structured to enclose the vacuum pump and the controller; and a mouthpiece removably and rigidly mountable to the pump housing, the mouthpiece including:

a pump-housing-engaging side structured to releasably mount to the pump housing on a mouthpiece-receiving side of the pump housing;

a lips-engaging side having a round rim with an elastomer outer surface, the round rim bounding a bowl, the bowl including a suction port providing fluidic communication between an interior of the bowl and an exterior of the bowl on the pump-housing-engaging side; and a releasable porous pad, wherein the releasable porous pad and the bowl are correspondingly dimensioned such that the releasable porous pad is releasably retained in the bowl of the mouthpiece via a friction fit, wherein the mouthpiece-receiving side of the pump housing includes a suction connector structured to fluidically couple the suction port of the mouthpiece with the vacuum pump when the mouthpiece is mounted to the pump housing, and wherein the releasable porous pad is configured to prevent complete fluidic sealing of the suction port of the bowl of the mouthpiece and the suction connector of the pump housing by a lip of the user, wherein positioning the lip-enhancement device to the user's lips includes positioning at least a majority of an upper vermillion and a lower vermillion of the user's lips in the bowl of the mouthpiece;

activating the vacuum pump of the lip-enhancement device, the vacuum pump drawing fluid from the bowl of the mouthpiece to produce a vacuum therein;

the controller of the lip-enhancement device deactivating the vacuum pump after a predetermined time interval; and re-activating the vacuum pump of the lip-enhancement device for an additional predetermined time interval if desired by user.

* * * * *